United States Patent [19]

Reed

[11] 3,939,014

[45] Feb. 17, 1976

[54] AQUEOUS ZINC PHOSPHATING SOLUTION AND METHOD OF RAPID COATING OF STEEL FOR DEFORMING

[75] Inventor: Stuart Reed, Warminster, Pa.

[73] Assignee: Amchem Products, Inc., Ambler, Pa.

[22] Filed: Nov. 20, 1974

[21] Appl. No.: 525,411

[52] U.S. Cl. ..... 148/6.15 Z
[51] Int. Cl.[2] ..... C23F 7/10
[58] Field of Search ..... 148/6.15 Z

[56] References Cited

UNITED STATES PATENTS

| | | | |
|---|---|---|---|
| 2,351,605 | 6/1944 | Gibson | 148/6.15 Z |
| 2,516,008 | 7/1950 | Lum | 148/6.15 Z |
| 2,884,351 | 4/1959 | Cavanagh | 148/6.15 Z |
| 2,930,723 | 3/1960 | Prysdale et al. | 148/6.15 Z |

FOREIGN PATENTS OR APPLICATIONS

| | | | |
|---|---|---|---|
| 1,040,020 | 8/1966 | United Kingdom | 148/6.15 Z |

*Primary Examiner*—Ralph S. Kendall
*Attorney, Agent, or Firm*—Ernest G. Szoke; Howard S. Katzoff; Michael E. Zall

[57] ABSTRACT

In the continuous strand method of processing high carbon steel wire for subsequent cold deformation, a zinc phosphate conversion coating is rapidly formed on the steel surface to aid in the subsequent deformation by contacting the steel surface with an aqueous acidic coating solution comprising phosphate, zinc and nitrate.

9 Claims, No Drawings

AQUEOUS ZINC PHOSPHATING SOLUTION AND METHOD OF RAPID COATING OF STEEL FOR DEFORMING

BACKGROUND OF THE INVENTION

When high-carbon steels are prepared for cold deformation, they are first heat treated. Particularly, when high carbon steel wire is prepared for cold deformation, the heat treating operation, known as "patenting" is performed in a continuous line. That is, the wire is run off of spools or coils through the heat treating furnace in a continuous strand. Following the heat treating operation, the steel wire is provided with a coating to aid in the subsequent deformation. Coatings on the steel surface in conjunction with suitable drawing lubricants, are known to aid in reducing friction between the metallic surface and the deforming tools. Coatings formed on the surface of metals, which are subsequently to be cold deformed, are required to serve functions in addition to aiding in the cold deformation of the steel. When the metallic article is not immediately deformed, a coating on the metallic surface provides protection against surface corrosion. In addition, the coated work pieces when passed through drawing lubricants prior to deforming, retain a greater amount of the lubricants than do non-coated surfaces. Phosphate coatings improve wire drawing operations by increasing the drawing speed, providing longer die life, and improving machine efficiency due, for example, to less stoppage for die replacement. They also substantially reduce die maintenance cost due to a more regular wearing of the dies. Better appearance and surface condition of the drawn wire, greater uniformity of cross section and increased resistance to corrosion are other advantages available from using phosphate coatings. The ability to draw wire of higher carbon content and higher tensile strength at increased speed is a further advantage.

Among the many phosphate coating compositions which are available to form the coatings, a zinc phosphate coating is preferred as an aid in wire drawing. Iron and manganese phosphate coatings have been tried and found substantially inferior as drawing aids. In addition, the manganese phosphate coatings are slower reacting, more costly to use and more difficult to control. Iron phosphate coatings do not produce sufficient coating weights for their use in wire drawing.

The optimum amount of phosphate coating for continuous wire drawing involving several size reduction steps is one which will give good performance at the last die without being excessive at the first die. Phosphate coatings can be too heavy and result in the creation of vibrations during size reduction in the drawing steps. Too light a coating will result in poor performance at the last die because insufficient coating is carried through to maintain the required separating layer between the die and the wire to prevent excessive wear of the die or scratching of the workpiece surface.

Coating weights of from about 450 to 1,550 mg/sq. ft. (5 to 16 g/m$^2$) of surface area are desirable for steel wire drawing. To obtain coating weights in excess of about 450 mg/sq. ft. (5 g/m$^2$) zinc phosphate compositions have been employed.

In some zinc phosphate coating operations, additional ionic constituents have been employed. Additional ionic constituents such as nickel and copper have been thought to influence the reaction of coating compositions on the metal surface and modify the character and properties of the phosphate coatings.

Phosphate coating compositions having phosphate, zinc and nitrate have been employed in the past. In addition compositions wherein the nitrite oxidizing agent is autocatalytically regenerated from nitrate in an operating coating bath have been employed. The nitrate and nitrite are useful in the operating coating bath to convert the dissolved iron from the divalent ferrous form into the trivalent ferric form. Since tertiary ferric phosphate is only slightly soluble in an acid phosphate coating bath, the dissolved iron is precipitated out of the solution as sludge and the bath is thus maintained in a so-called "iron-free" condition.

In the attempts to form zinc phosphate coatings it has not been possible to form coatings of greater than about 450 mg/sq. ft. (5 g/m$^2$) on high carbon steel in less than about 30 seconds. Additionally the autocatalytic regeneration of nitrite fails at the low bath loading rates common to the continuous strand processing methods.

Because zinc phosphate coatings of greater than about 450 mg/sq. ft. (5 g/m$^2$) could not be formed with sufficient speed to be incorporated into a continuous strand, wire heat-treating line, the wire has frequently been recoiled subsequent to heat treating for a later coating operation. The recoiled wire could then be contacted with a coating bath over a longer period of time by slowing the speed of the moving wire. The recoiled wire has also been coated in the coiled or rolled state. When a coil or roll of wire is coated in the coil or roll, that is without unrolling, the resulting coating is not uniform in thickness over the entire surface area, because the coating composition is not contacted uniformly with the metal surface throughout the suspended coil or roll. Sophisticated apparatus must then be used to shake the coils and rolls or drop them sharply in attempts to open the coils or rolls enabling better contact with the coating baths. Because of the time and costs involved for recoiling and coating, it is desired to eliminate these steps. To eliminate the recoiling and separate treating steps, attempts to apply a conversion coating on the steel surface as the wire leaves the heat-treating step have been made.

When applied to high carbon steel wire "patenting" or heat-treating lines moving at high speed in a continuous operation, the prior art phosphate coating processes have been found deficient in their application. High carbon steel has been found to be particularly difficult to coat. To withstand the heavy pressures in the deforming operation, particularly in those of high carbon steel wire drawing, coatings of from about 450 to about 1,200 mg/sq. ft. (5 to about 13 g/m$^2$) coating weight are desired. When small diameter high carbon steel wire is heat treated, speeds of up to 200 feet (70 meters) per minute have been obtained. Such high carbon steel wire in a continuous heat-treating operation, when immediately provided with a zinc phosphate coating without rerolling or recoiling subsequent to heat treating and prior to coating, has required a coating stage of up to about 100 feet (30.5 meters) due to the long coating time required. The costs of apparatus and work space make such a practice prohibitive. To save space, which is at a premium, it is desirable to limit the coating stage to no more than about 25 feet (7.6 meters).

Attempts to rapidly apply uniform zinc phosphate coatings on surfaces of high carbon steel wire have resulted in coatings which are deficient in coating weight.

OBJECTS OF THE INVENTION

The primary object of this invention is to provide a method and a zinc phosphate coating solution for forming on high carbon steel surfaces an adherent conversion coating, sufficient for wire drawing.

An important object of the invention is to provide a method and a zinc-phosphate coating solution for rapidly forming a zinc phosphate coating on a high carbon steel surface which can be employed in a continuous strand wire heat-treating line.

Another object of the invention is to provide a coating solution which is operable at a temperature lower than normally employed in the art.

Another object of the invention is to form on a high carbon steel surface, a zinc phosphate coating of from about 450 to about 1,200 mg/sq. ft. (5 to about 13 g/m$^2$) which aids in the subsequent deforming or drawing operations.

A concomitant object of the invention is to provide on a high carbon steel surface, a coating which aids in the subsequent adhesion of drawing or deforming lubricants.

DETAILED DESCRIPTION OF THE INVENTION

The present invention relates to a method and coating solution for rapidly and continuously producing a zinc phosphate conversion coating on a heat-treated high carbon steel wire which aids in subsequent high speed deformation of the steel. The process comprises contacting the steel surface subsequent to pickling and water rinse steps with an aqueous acidic coating solution comprising phosphate, zinc and nitrate at a temperature of less than about 90°C for less than about 15 seconds. Thereafter the coated surface is rinsed and dried.

The terms "zinc phosphate coating solution" and "coating solution" employed herein mean the aqueous acidic solution of the invention comprising phosphate, zinc and nitrate as described hereinbelow.

The terms "steel" and "high carbon steel" employed herein meaan the class of steels having more than about 0.30 percent by weight of carbon therein.

The coating solution of the invention can be prepared in several ways. The constituents can be added individually to water in the form of their acid, oxide, water soluble salt and the like, so long as the parameters of the coating solution as described hereinbelow are fulfilled. For example, zinc dihydrogen phosphate, zinc nitrate and phosphoric acid can be employed to make a coating solution of the invention. Preferably a concentrate is prepared which is subsequently added to water to make the coating solution.

To prepare the concentrate, it is preferred to supply the phosphate in the form of phosphoric acid, the zinc in the form of zinc oxide and the nitrate in the form of nitric acid. By employing phosphoric acid, zinc oxide and nitric acid to supply the constituents, an aqueous acidic concentrate can be prepared which can subsequently be added to water in the proper proportions to prepare the coating solution of the invention.

Certain other of the metallic cations as are known to be present in zinc phosphating compositions can be employed in the coating solution of the invention so long as the form in which they are supplied causes no harm in the performance of the coating solution. For example, the coating solution can comprise in addition to phosphate, zinc, and nitrate; additional constituents such as nickel, copper and calcium.

The additional constituents can be introduced to the coating solution in any acceptable form, such as their soluble salts, which will dissociate to nickel ion, copper ion and calcium ion.

Trace quantities of ferric ion can also be present in the coating solution resulting from the action of the coating solution in contact with the steel surface. The insolubility of ferric phosphate prevents more than the trace quantities of ferric ion in the solution.

In employing the coating solution of the invention, the amounts of the constituents therein are important to the rapid formation of a suitable conversion coating on a steel surface to aid in the subsequent deformation of the steel.

In the coating solution, phosphate can be present in the amount of from about 10 to about 150 grams per liter. Zinc can be present in the coating solution in the amount of from about 5 to about 100 grams per liter. Nitrate can be present in the coating solution in the amount of from about 10 to about 80 grams per liter. In addition to the phosphate, zinc and nitrate present in the amount stated above, the ratio of the amounts of the constituents in the coating solution have been found to be important. The zinc in the coating solution is present in the amount of from about 0.4 to about 1.2 parts by weight for each part of phosphate, and nitrate is present in the amount of from about 0.4 to about 1.6 parts by weight for each part of phosphate. Within the above parameters of the constituents, there have been found to be ranges which are preferred for use in the process of the invention.

It is preferred, therefore, that the phosphate be present in the coating solution in the amount of about 35 to about 55 grams per liter, the zinc be present in the amount of about 30 to about 50 grams per liter and the nitrate be present in the amount of about 20 to about 50 grams per liter.

It has been found that to obtain a coating weight of at least about 450 mg/sq. ft. (5 g/m$^2$) in the shortest period of time it is necessary that the nitrate be present in the coating solution such that the ratio of nitrate to phosphate is from about 0.4 to about 1.6 parts by weight and is preferably present in the coating solution in the amount of from about 20 to about 50 g/l.

A preferred coating solution of the invention can be prepared, for example, by adding to water, a concentrate according to Formula I or Formula II below.

| CONSTITUENT COMPOUND | GRAMS PER LITER FORMULA I | FORMULA II |
|---|---|---|
| Zinc oxide | 287 | 270 |
| Phosphoric acid | 322 | 222 |
| Nitric acid | 324 | 220 |
| Nickel carbonate | 1 | — |
| Ferric chloride | 4 | — |
| Water to make one liter | | |

The ferric chloride shown in the formula above is added to improve the stability of the concentrate and has no utility in the operation of the coating solution as far as is known.

Reference is made to acidity herein in terms of "points of total acid", "points of free acid" and "acid ratio" or "total acid to free acid ratio". The terms "total pointage" and "points of total acid" means the total acidity of a solution as measured by the number of milliliters of N/10 NaOH needed to titrate a 10 milliliter sample of the coating solution to a pink end-point using phenolphthalein as an indicator. To determine the "points of free acid" of a coating solution, a 10 milliliter sample is titrated with N/10 NaOH to a bromophenol blue end point and the number of milliliters of N/10 NaOH required is the "points of free acid" of the solution. The "acid ratio" or "total acid to free acid ratio" is calculated as the points of total acid divided by the points of free acid.

The acidity of the coating solution is influenced by many factors, and consequently the points of total acid, the points of free acid and the acid ratio to be discussed in greater detail below, are of importance in the coating solution.

The process of the invention has an advantage wherein it is unnecessary to periodically replenish nitrite. At the inception of an operating solution however, it is advisable to establish a nitrite concentration of at least about 0.1 grams per liter. Thereafter no further nitrite need be added in the course of a working cycle, since nitrite will be autocatalytically generated from the nitrate present in the coating solution in an amount sufficient to maintain a concentration of nitrite in an amount of at least 0.1 grams per liter. The nitrate is normally maintained in a sufficient amount by the addition of nitric acid to maintain the free acidity of the coating solution. When the amount of steel surface in contact with the coating solution is small in comparison to the volume of coating solution, that is, when bath loading is small, there can be insufficient residual nitrite in solution to commence a new cycle of operation with coating solution which has not been used for a period of time without the need to add nitrite again. Because it is difficult to determine if nitrite autocatalytic generation will initiate, it is preferred to add a small amount of nitrite to the coating solution to ensure the commencement of autocatalytic generation from nitrate should the coating solution not be used for a time. The reason, of course, is that nitrite breaks down in the acidic solution and is lost. Without a throughput of steel surfaces, autocatalytic regeneration of nitrite from nitrate would stop.

Should a nitrite be added, it can be added to the coating solution in the form of any of its soluble salts so long as the salt cation does not interfere with the operation of the coating solution. For example, an alkali metal nitrite such as sodium nitrite, potasium nitrite, ammonium nitrite and zinc nitrite can be employed. It is preferable to employ sodium nitrite as it is easily obtainable and economical as well as being suitable in the coating solution. In the process of producing the zinc phosphate coating on a steel surface, constituents of the coating solution naturally become depleted. Depletion can occur in numerous ways. For example, phosphate and the metallic cations present in the coating solution are deposited in the coating formed when the steel surface is contacted with the coating solution. Of course the nitrate is depleted in the course of generating nitrite. The free acidity can require adjustment because of the hydrogen ion attack on the steel surface. In the process of forming the coating, the constituents are depleted at different rates from the coating solution. For example, phosphate and zinc are depleted at a faster rate than nitrate.

As depletion occurs, replenishment of the coating solution is required to maintain the effective amounts of the constituents therein. The amounts of the constituents supplied can be determined by any method employed in the art for determining the composition of other zinc phosphating solutions. Any constituent found to be depleted can be added. However, it is preferred to determine the depletion rate of the constituents and replenish by the simple addition to the solutions of a liquid concentrate to maintain the coating solution.

A replenishing concentrate comprising phosphate, zinc and nitrate can be prepared for example, from zinc oxide dissolved in an aqueous solution of phosphoric and nitric acids, wherein the phosphate to zinc to nitrate weight ratio is preferably near the numerically lower end of the previously disclosed range, or about 1: (0.4 to 0.6) : (0.4 to 0.7). Additionally, the replenishing concentrate can comprise the constituents of copper, nickel, and calcium depleted from the coating solution, should they be present originally.

Naturally, the phosphate coating solution must be replenished whenever necessary with phosphate, zinc and nitrate ions in order to replace these as they are consumed in the coating reaction. As already indicated, it is necessary for the success of the process of this invention that the replenishment material should contain phosphate, zinc and nitrate ions in the previously-specified ratios, but in other respects the replenishment is carried out in the usual manner, for example, by adding a concentrate containing the necessary ratios of phosphate, zinc and nitrate whenever appropriate. The consumption of phosphate and zinc in the coating reaction can be monitored in the conventional manner by determining the total pointage, as previously described, and raising it to the desired value by adding a definite quantity (depending on the total volume of the coating solution) for each point to be restored. The total pointage is not critical since the process of the invention will produce good phosphate coatings to a large extent independently of the total pointage, thus at both low and high pointages, but as a general rule one replenishes so as to restore the total pointage to approximately its original value, which is from about 110 to about 140 points, and preferably is from about 120 to about 130 points.

Besides the total pointage, which is a measure of the total acidity of the solution, there is another related factor which affects the process, namely the free acidity of the coating solution. As stated previously the ratio of total acid to free acid is a significant factor which influences both the speed and amount of coating in a certain time period, but also the rate at which autocatalytic generation of nitrite takes place. It has been determined that it is not practicable to operate the process with a coating solution having an acid ratio of less than about 4.5 as excessive etching of the steel surface can occur. The acid ratio should likewise not exceed about 8.5, and preferably the acid ratio should be from about 6 to about 7.

Should replenishment be required, a replenishing concentrate which is suitable, for example, is one comprised of phosphoric acid, zinc oxide and nitric acid according to Formula III below.

| FORMULA III | g/l |
|---|---|
| Zinc oxide | 100 |
| Phosphoric acid | 163 |
| Nitric acid | 100 |
| Water | Balance to 1 liter |

Importantly, the temperature of the aqueous coating solution of the invention need not be as high as that commonly employed in the art. The temperature of the coating solution in the process of the invention by which a zinc phosphate coating is rapidly produced can be from about 70°C to about 90°C. It is preferable to maintain the coating solution at a temperature of about 77°C to about 85°C.

The maximum temperature of the coating solution is not critically set at 90°C. If desired, the coating solution can be used at temperatures exceeding 90°C without adverse effects. However, because of energy availability and the cost for maintaining a higher temperature, it is preferred to operate with as little required heat as possible.

When employing the phosphate coating solution to contact the steel surface, any contacting technique known to the art can be employed. Techniques known to the art such as spraying, brushing, dipping, roller-coating, flow-coating and the like can be employed.

A surprising aspect of the invention is that coating weights in excess of about 450 mg/sq. ft. (5g/m$^2$) are formed in periods of time as low as about 5 seconds. Periods of time greater than 15 seconds are not harmful, and in fact can be beneficial by producing heavier coating weights. Preferably the coating solution is contacted with the steel surface for from about 5 to about 15 seconds. Consequently, the process of the invention can be employed in a continuous strand heat treating line.

In the practice of zinc phosphating a steel wire for deforming, the surface is cleaned by physical and/or chemical means to remove oxide. In the typical practice, the steel surface is pickled subsequent to the heat-treating or "patenting" operation. In the acid pickling step, any method commonly employed in the art is acceptable. For example, a 25 percent hydrochloric acid pickling solution operated at a temperature of about 70°C for cleaning heat treated steel wire during a period of less than about 15 seconds can be employed.

Subsequent to the pickling operation, a water rinse can be employed to prevent contamination in the subsequent steps of the process.

Subsequent to pickling and prior to contacting the metal surface with the phosphate coating solution, a conditioning or activating pretreatment rinse can be employed. Should a conditioning rinse be employed, it is preferred to use an aqueous rinse having colloidal titanium or zirconium compounds therein. A conditioning pretreatment can aid in the accelerated formation of the subsequently formed coating, resulting in the enhanced quality and uniformity of the coating.

For example, a mildly acidic aqueous composition having a dialkali metal orthophosphate, an alkali metal titanium fluoride and an organic acid has been formed suitable.

Subsequent to the water rinse, or to the conditioning rinse, the steel surface is contacted with the coating solution of the invention as described above.

Following the phosphate coating step, the coated steel surface is rinsed with water. A suitable water rinse can be at a temperature of from about 65°C to about 90°C. Metal surfaces, heated as such in the rinse bath, dry quickly.

A neutralizing bath can be employed subsequent to the coating step to neutralize any residual acidity on the steel surface. It is desirable to water rinse prior to neutralizing so that the neutralizing bath is not contaminated by acid drag-out. Such a bath neutralizes any residual acid carried through the water rinse on the coated surface. A suitable neutralizing bath is mildly alkaline, for example pH 8 to 10. Should the neutralizing bath be employed, its temperature can be about 65°C to about 90°C to aid in drying the coated surface. More rapid drying of the coated surface can be obtained by force drying the surface. For example, a forced air blast can be employed.

Should it be desired, the coated metal surface can be contacted with a liquid drawing lubricant composition prior to drying. The drawing lubricant composition can have a small amount of fatty acid or a fatty acid soap which can be in the form of a solution, a suspension or an emulsion. Certain partially esterfied fatty acid compositions can have an additional value, in that they can be esterfied further with metallic ions in the coating. Adhesion of the lubricant composition to the surface can be enhanced thereby.

Subsequently additional wet or dry deforming lubricants to aid in drawing can be applied to the coated, rinsed, and dried surfaces. Such deforming lubricants can be contacted with the coated surface just prior to the deforming operations.

In order that the invention shall be more clearly understood, there will be described in more detail certain embodiments, but only by way of illustration in the following examples:

EXAMPLE I

Illustrative of the process of the invention, high carbon steel hot-rolled wire of 2 mm diameter was prepared to contact the solutions listed in Table 1 in the following manner:

1. The steel wire had been heat treated previously. This step was carried out in a wire treating and drawing plant.

2. The heat-treated wire was cut into 20 centimeter segments.

3. The wire segments were each pickled at 71°C for 3 minutes in 25 percent hydrochloric acid for scale removal. The longer period of time required for pickling in this test over the time of about 15 seconds mentioned previously is due to the lower temperature of the wire segments entering the pickling stage as compared to wire in a continuous strand heat-treating process. The wire segments having cooled to room temperature following the heat-treating step, require the longer time in the pickling solution for cleaning.

4. The wire segments were each water rinsed by immersion subsequent to pickling. The temperature of the rinse was maintained at 71°C.

5. The wire segments were quick-dipped in an aqueous conditioning or activating composition comprising a collodial form of titanium, orthophosphate, and sodium citrate, which was maintained at a pH of 7 and a temperature of 71°C.

Subsequent to the preparation steps above, particular wire segments were contacted with the respective solutions listed in Table 1 below.

The solutions employed in this test were prepared by adding to water, zinc oxide, phosphoric acid and nitric acid in the amounts shown in Table 1.

The wire segments were contacted with the respective solutions by immersion for 8 seconds and at 82°C.

Following the immersion coating treatment, the wire test segments were removed from the solutions and rinsed in water at room temperature, i.e. about 21°C.

Subsequent to the rinse step, the wire segments were dried by compressed air at room temperature for about 2 minutes.

Subsequent to the steps above, the coatings produced were evaluated by determining the coating weight on the wire test segments. The coating weights were determined in the following manner:

The wire segments were weighed and stripped in 5 percent chromic acid at a temperature of 70°C by immersing for 5 minutes. Following the stripping procedure the segments were dried in a compressed air stream, and again weighed. The difference in weight was employed to calculate the coating weight in mg of coating per square foot of wire surface. The coating weights are compiled in Table 1 below.

TABLE 1

| AMOUNTS OF THE CONSTITUENTS EMPLOYED TO MAKE THE SOLUTIONS (g/l) | POINTS OF ACID Total/Free | COATING WEIGHT mg/sq foot |
|---|---|---|
| $H_3PO_4$(41), ZnO(44), $HNO_3$(48) | 121/20 | 589.0 |
| $H_3PO_4$(45), ZnO(47), $HNO_3$(50) | 128/20 | 529.0 |
| $H_3PO_4$(45), ZnO(50), $HNO_3$(51) | 121/18 | 578.0 |
| $H_3PO_4$(47), ZnO(46), $HNO_3$(59) | 131/22 | 524.0 |
| $H_3PO_4$(47), ZnO(56), $HNO_3$(68) | 137/-- | 680.0 |

EXAMPLE 2

Segments of high carbon steel wire, 20 centimeters in length by 2 millimeters in diameter were prepared for contacting the coating solution in the same manner as described in Example 1. The wire segments were contacted with the following coating solution for periods of time of 5, 8, 10, 15, 30, and 60 seconds and 5 minutes respectively.

A coating solution prepared by adding 162.5 ml of Formula 1 to 837.5 ml of water was employed at a temperature of 82°C to contact the wire segment.

Subsequent to contacting the wire segments with the coating solutions for the respective periods of time, the wire was water rinsed and dried with compressed air. Coating weights of the dry test segments were determined in the same manner as described in Example 1 above. The results are compiled in Table 2 below.

TABLE 2

| COATING TIME | AVERAGE COATING WEIGHT mg/sq.ft. |
|---|---|
| a) 5 seconds | 516 |
| b) 8 seconds | 569 |
| c) 10 seconds | 630 |
| d) 15 seconds | 654 |
| e) 30 seconds | 720 |
| f) 60 seconds | 701 |
| g) 5 minutes | 723 |

EXAMPLE 3

This example illustrates solutions having nitrate anion in an amount greater than about 0.4 parts for each part by weight of phosphate in solution.

Wire segments 20 centimeters long by 2 millimeters in diameter of high carbon steel wire were obtained and prepared for contacting the test solutions as described in Example 1 above. The wire segments were contacted with the respective test solutions comprising phosphate, zinc and nitrate. The solutions were prepared by adding to water, zinc oxide, phosphoric acid and sodium nitrate in the amounts shown in Table 3 below. It should be noted that solution (a) is a control solution wherein no nitrate is present in the solution.

The wire segments were contacted with the respective solutions for 8 seconds. The wire segments were then water rinsed and air dried. The coating weights of coatings formed by contacting the segments with the respective solutions were determined in the same manner as described in Example 1 above. The coating weights are compiled in Table 3 below.

TABLE 3

| AMOUNTS OF THE INGREDIENTS OF THE TEST SOLUTIONS (g/l) | ACID POINTS Total/Free | COATING WEIGHTS mg/sq.foot |
|---|---|---|
| a) $H_3PO_4$(90), ZnO(47) | 137/22 | 159 |
| b) $H_3PO_4$(90), ZnO(47), $NaNO_3$(60) | 127/20 | 457 |
| c) $H_3PO_4$(90), ZnO(47), $NaNO_3$(120) | 126/19 | 410 |

The specific compositions and the methods of producing zincphosphate coatings on the ferrous surfaces in the examples above serve to exemplify the invention as previously described and form no limits except as imposed by the following claims.

I claim:

1. A process for forming a zinc phosphate coating on a steel surface comprising contacting the steel surface with an acidic aqueous coating solution consisting essentially of phosphate, zinc and nitrate, wherein the zinc is present in the coating solution in an amount of from about 0.4 to about 1.2 parts by weight for each part of the phosphate and the nitrate is present in the solution in an amount of from about 0.4 to about 1.6 parts by weight for each part of the phosphate, the phosphate being present in the coating solution in an amount of from about 10 g/l to about 150 g/l, the zinc being present in an amount of from about 5 g/l to about 100 g/l, and the nitrate being present in an amount of from about 10 g/l to about 80 g/l and the ratio of total acid to free acid in the coating solution is from about 4.5 to about 8.5 with the total acidity of the coating solution being from about 110 to about 140 points.

2. The process of claim 1, wherein the coating solution consists essentially of the phosphate in the amount of from about 35 g/l to about 55 g/l, the zinc in the amount of from about 30 g/l to about 50 g/l, and the nitrate in the amount of from about 20 to about 50 g/l.

3. The process of claim 1, wherein the ratio of total acid to free acid in the coating solution is from about 6 to about 7.

4. The process of claim 1, wherein the total acidity of the coating solution is from about 120 to about 130 points.

5. A process for forming a zinc phosphate coating on a steel surface comprising:

acid pickling the steel surface;

water rinsing the steel surface;

contacting the steel surface with an acidic aqueous coating solution consisting essentially of phosphate in the amount of from about 10 g/l to about 150 g/l, zinc in the amount of from about 5 g/l to about 100 g/l, and nitrate in the amount of from about 10 g/l to about 80 g/l, and wherein the zinc is present in the coating solution in an amount of from about 0.4 to about 1.2 parts by weight for each part of the phosphate, and the nitrate is present in the solution in an amount from about 0.4 to about 1.6 parts by weight for each part of the phosphate;

water rinsing the steel surface; and drying the steel surface.

6. The process of claim 5, wherein the rinsing of the steel surface following the acid pickling step comprises first contacting the surface with a water rinse and thereafter contacting the surface with an aqueous conditioning solution.

7. The process of claim 6, wherein the aqueous conditioning solution comprises an aqueous colloidal titanium composition.

8. The process of claim 5, wherein the rinsing of the steel surface following contact with the coating solution comprises first contacting the surface with a water rinse, and thereafter contacting the surface with an alkaline neutralizing rinse.

9. An acidic aqueous coating solution consisting essentially of phosphate, zinc and nitrate, wherein the phosphate is present in the solution in the amount of from about 35 g/l to about 55 g/l, the zinc is present in the solution in the amount of from about 30 g/l to about 50 g/l and the nitrate is present in the solution in the amount of from about 20 g/l to about 50 g/l, and wherein there is present in the solution for each part of the phosphate, from about 0.4 to about 1.2 parts of the zinc and from about 0.4 to about 1.6 parts of the nitrate; and wherein the total acidity of the solution is from about 110 points to about 140 points and the total acid to free acid ratio is from about 4.5 to about 8.5.

* * * * *